US006400278B1

(12) United States Patent
Weyerstall et al.

(10) Patent No.: US 6,400,278 B1
(45) Date of Patent: Jun. 4, 2002

(54) MOTOR VEHICLE CLOSING DEVICE WITH A POSITION RECOGNITION SYSTEM FOR A MOVEABLE CONTROL ELEMENT

(75) Inventors: Bernd Weyerstall, Wuppertal; Burkhard Drees, Werdohl, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/485,683

(22) PCT Filed: Aug. 25, 1998

(86) PCT No.: PCT/DE98/02499

§ 371 (c)(1),
(2), (4) Date: Feb. 25, 2000

(87) PCT Pub. No.: WO99/10615

PCT Pub. Date: Mar. 4, 1999

(30) Foreign Application Priority Data

Aug. 25, 1997 (DE) ..... 197 36 738
Sep. 30, 1997 (DE) ..... 197 43 129

(51) Int. Cl.[7] ..... G08B 21/00
(52) U.S. Cl. ..... 340/686.3; 292/216; 324/207.22
(58) Field of Search ..... 340/686.3, 672, 340/539, 542; 307/10.1; 318/282; 49/280, 360; 292/201, 216; 324/207.2, 207.21, 207.22

(56) References Cited

U.S. PATENT DOCUMENTS 5,155,937 A 10/1992 Yamagishi et al. ..... 49/280
5,722,706 A * 3/1998 Bartel et al. ..... 292/216
5,765,884 A * 6/1998 Armbruster ..... 292/216

FOREIGN PATENT DOCUMENTS

| | | |
|---|---|---|
| DE | 39 41 086 | 6/1991 |
| DE | 42 22 018 | 6/1993 |
| DE | 44 33 042 | 10/1995 |
| DE | 296 18 688 | 1/1997 |
| DE | 195 33 193 | 3/1997 |
| EP | 0 346 317 | 12/1989 |

* cited by examiner

*Primary Examiner*—Thomas Mullen
(74) *Attorney, Agent, or Firm*—Nixon Peabody LLP; David S. Safran

(57) ABSTRACT

The subject matter of the invention is a motor vehicle closing device with a positioning element (3) which turns around one axis of rotation (7) or which moves linearly along one lengthwise axis and which has a position which is to be ascertained, and with a position detection means (8) which works without contact and which is located on the path of motion of the positioning element (3) (or on the positioning element 3 itself). It thus lends itself to "diagnosis" by the fact that on the positioning element (3) (or on the path of movement of the positioning element 3) in the direction of its motion there are several passive position detection elements (9) in succession and that position detection takes place by counting the signals of the position detection elements (9) by the position detection means (8). In particular it is provided that the position detection means (8) has a sensor which is sensitive to magnetic fields, especially a Hall sensor, a reed contact or a magnetoresistive sensor and the position detection elements (9) are made as alternatingly magnetic and nomnagnetic pole zones or pole zones which are magnetized with changing polarity.

18 Claims, 5 Drawing Sheets

FIG. 3B
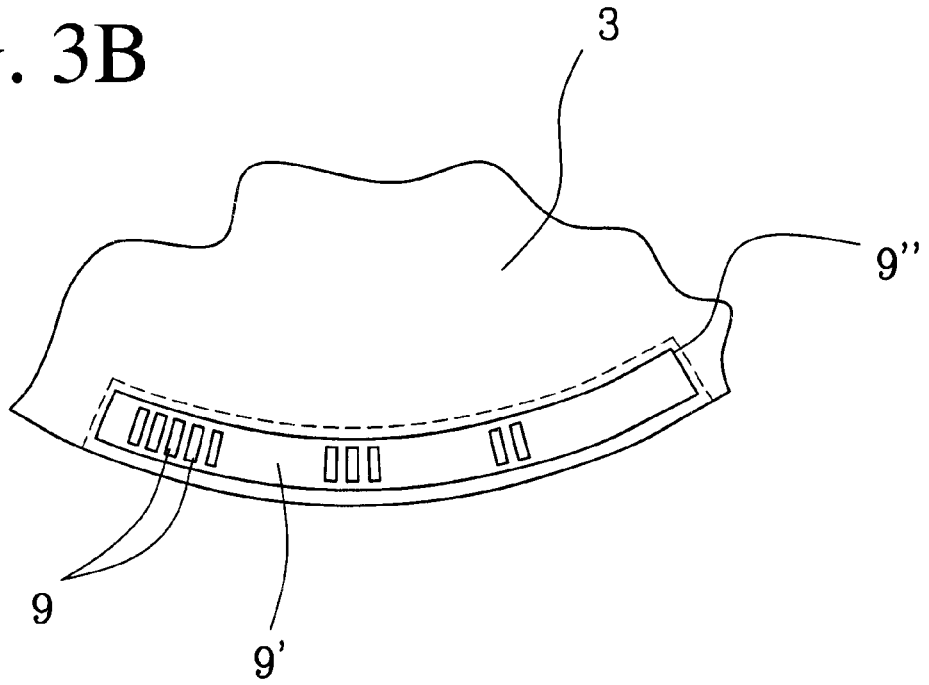
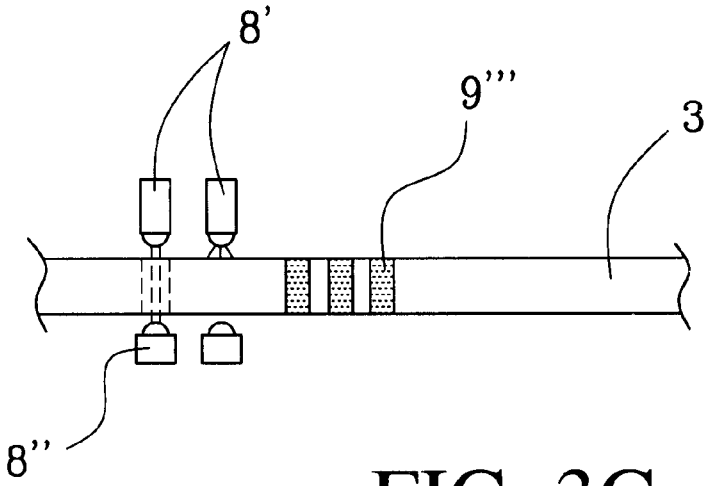
FIG. 3C

MOTOR VEHICLE CLOSING DEVICE WITH A POSITION RECOGNITION SYSTEM FOR A MOVEABLE CONTROL ELEMENT

BACKGROUND OF THE INVENTION

1. Field of the Invention

The invention relates to a motor vehicle closing device with position detection of a moving positioning element, where moving the positioning element turns around an axis of rotation or moves linearly along a longitudinal axis and has a position which is to be ascertained, and where the device has a position detector which works without contact and which is located along the path of motion of the positioning element (or on the positioning element itself).

2. Description of Related Art

In the known motor vehicle closing device underlying the invention, the moving positioning element is the rotary latch of the motor vehicle closing device which, together with the detent pawl which keeps it in the preliminary catch and the main catch, forms the closing elements of one such closing device published German Patent Application No. 44 33 042. In this closing device, the position of the rotary latch which represents the positioning element here is ascertained via a position detection means which is located on the path of movement of the rotary latch and which operates without contact. On the rotary latch there is, for this purpose, a position detection element arranged such that it influences the position detection means in the "rotary latch in closed position" position so that the position detection means delivers the "motor vehicle door closed" signal. In all other positions of the rotary latch, the position detection element is not in the position in which it influences the position detection means, all other positions therefore have the "motor vehicle door open" signal.

For positioning elements of central locking systems, closing aids, or the like, especially for the worm wheels of the worm gear pairs often used in motor vehicle closing devices, ascertaining the position of the positioning element by switches or sliding contacts as the position detection means is known. These position detection means are subjected to physical changes, are dependent on temperature, and overall are tolerance-sensitive. Based on the mechanical structure, operating points can be unintentionally overrun, and malfunctions are common. But, since it is increasingly required that motor vehicle closing devices also lend themselves to "diagnosis," it must be possible to exactly and reproducibly acquire the positions of their important components.

SUMMARY OF THE INVENTION

The object of the invention is to embody and develop the known motor vehicle closing device explained initially such that it enables comprehensive position acquisition of the essential moving positioning elements, acquisition which is insensitive to tolerances and for the most part error-free.

The aforementioned object is achieved in a motor vehicle closing device with a moving positioning element, where the moving positioning element turns around an axis of rotation or moves linearly along a longitudinal axis and has a position which is to be ascertained, and where the device has a position detector which works without contact and which is located along the path of motion of the positioning element (or on the positioning element itself), by there being several passive position detection elements in succession on the positioning element (or along the path of movement of the positioning element) in the direction of its motion, and position detection taking place by counting the signals of the position detection elements by the position detector.

It is proposed in accordance with the invention how the position detection which is known in the rotary latch of a motor vehicle closing device can be expanded for a comprehensive position detection system of moving positioning elements in motor vehicle closing devices.

Advantageous embodiments and developments of the teaching are detailed below in conjunction with the explanation of one preferred embodiment of a motor vehicle closing device in accordance with the invention using the drawings.

BRIEF DESCRIPTION OF THE DRAWINGS

FIG. 3B shows another alternative worm wheel with plastic strips carrying magnets.

FIG. 3C shows a side-view of worm wheel in an alternative opto-electronic arrangement for position detection means.

For the further examination FIGS. 1 to 4 are to be understood and explained in combination.

DETAILED DESCRIPTION OF THE INVENTION

Figure 1:
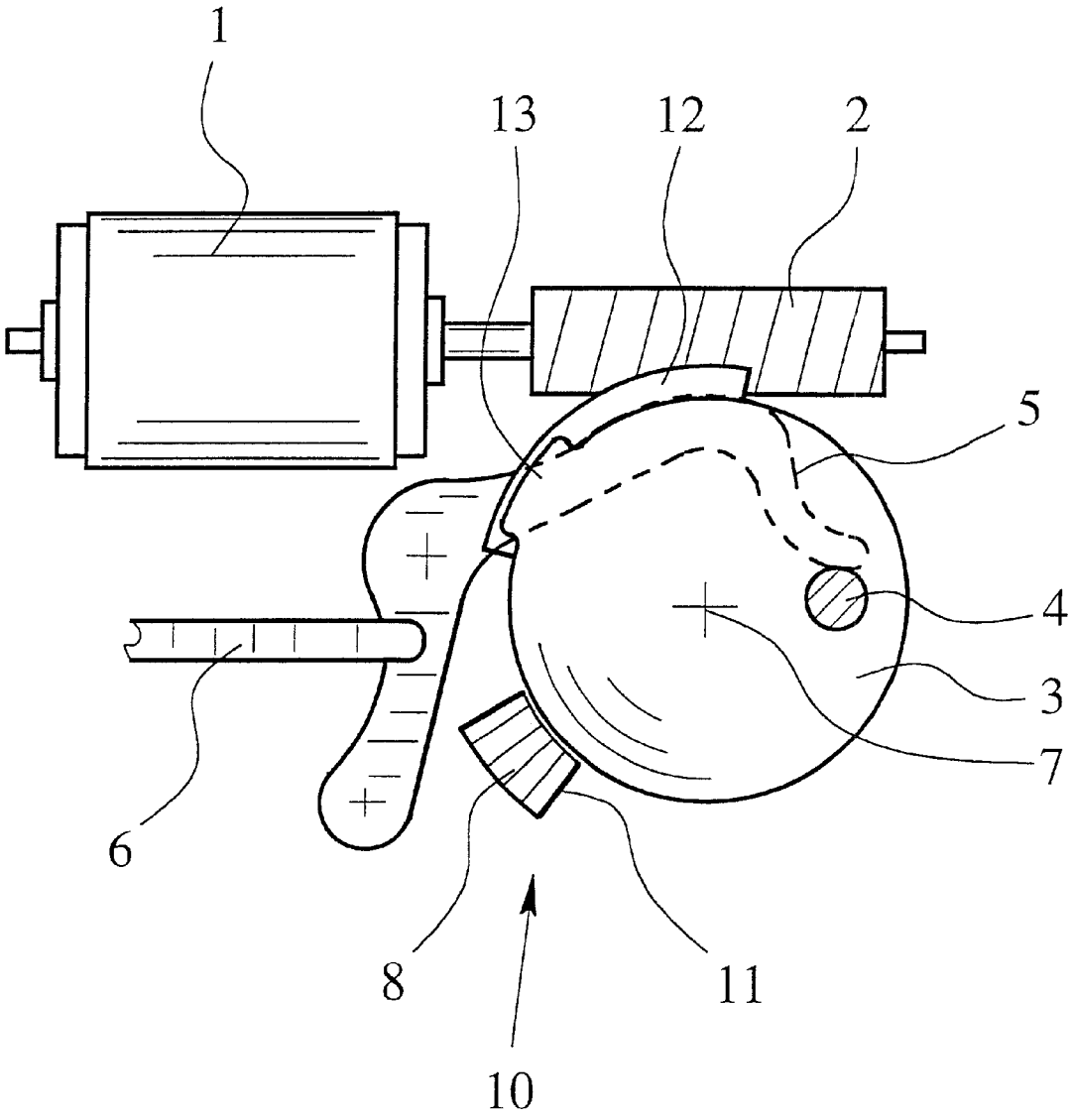
FIG. 1 shows a motor vehicle closing device with a motorized opening aid with a worm wheel as the movable positioning element in "ready to open" position.
Figure 2:
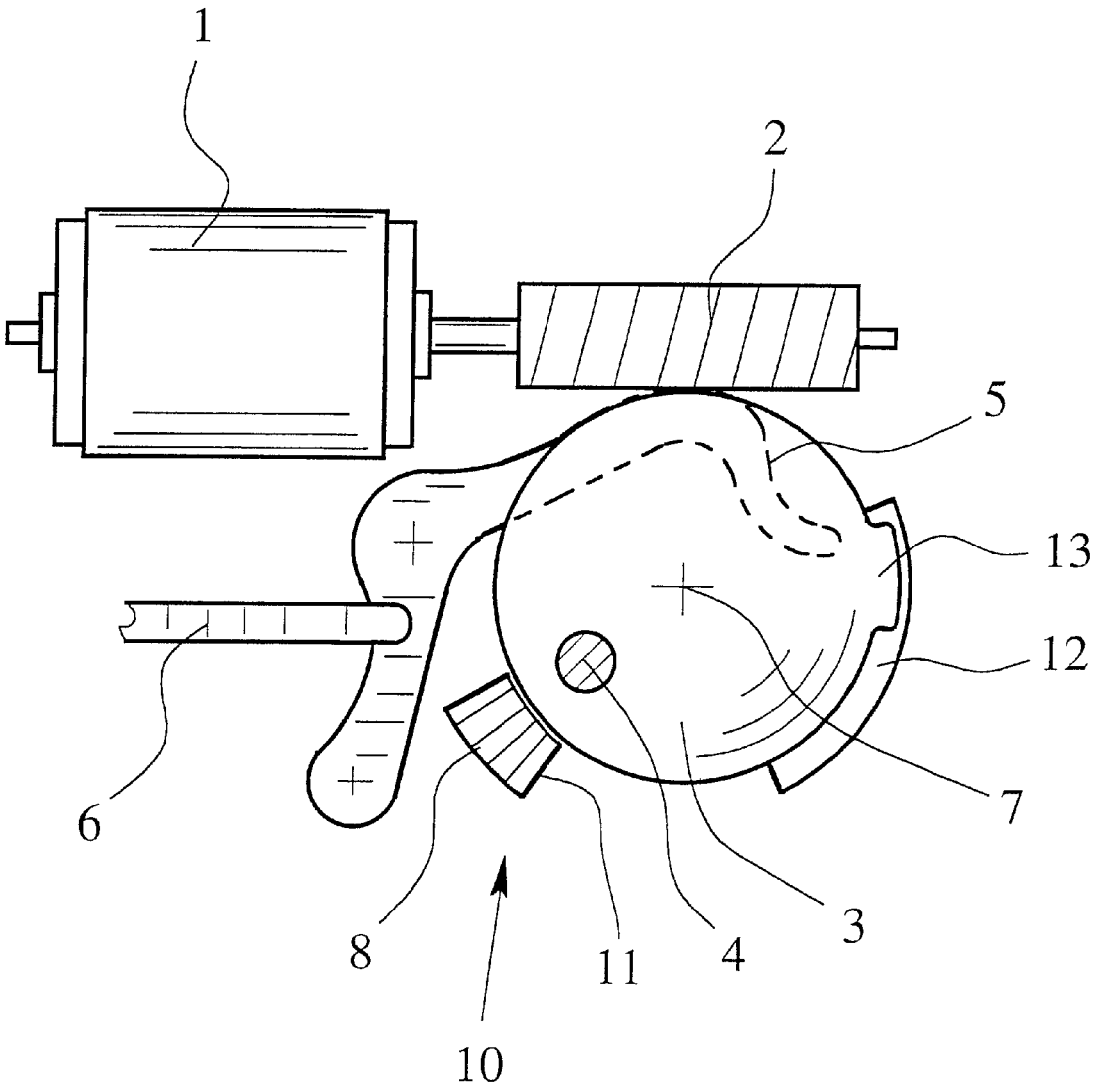
FIG. 2 shows the motor vehicle closing device from FIG. 1 in the "anti-theft" position.

A motor vehicle closing device is shown, here by way of an extract in the area of a motorized opening aid with an electrical drive motor 1, a spindle 2 of a worm gear pair, a worm wheel 3 of the worm gear pair, a driver journal 4 on the worm wheel 3 of the worm gear pair, an opening lever 5 and a transmission rod 6. This representation is one example of one application of the teaching of the invention in a motor vehicle closing device. Other examples are central locking system drives, anti-theft locking drives, closing aids, but also position detection of a rotary latch as explained initially on the prior art, other levers in the lock mechanism of a motor vehicle closing device or, for example, the door lock nut, with which a door closing cylinder is coupled to the lock mechanism. In the following, the teaching of the invention is explained using the example shown without this being understood as limiting.

In this embodiment, the worm wheel 3 is a positioning element which turns around a rotary axle 7 in the sense of the invention. As an alternative, it would be conceivable for a positioning element to be linearly movable along a longitudinal axis; for example, this is rather common in central locking system actuators. In any case, it will be possible to ascertain the position of the positioning element 3 at any time. To do this, there is a position detection means 8 which operates without contact by the path of motion of the positioning element 3.

Basically, the arrangement can also be made such that the position detection means 8 is located on the positioning element 3. But, this then requires signal transmission to the control, for example, without contact.

Figure 3:
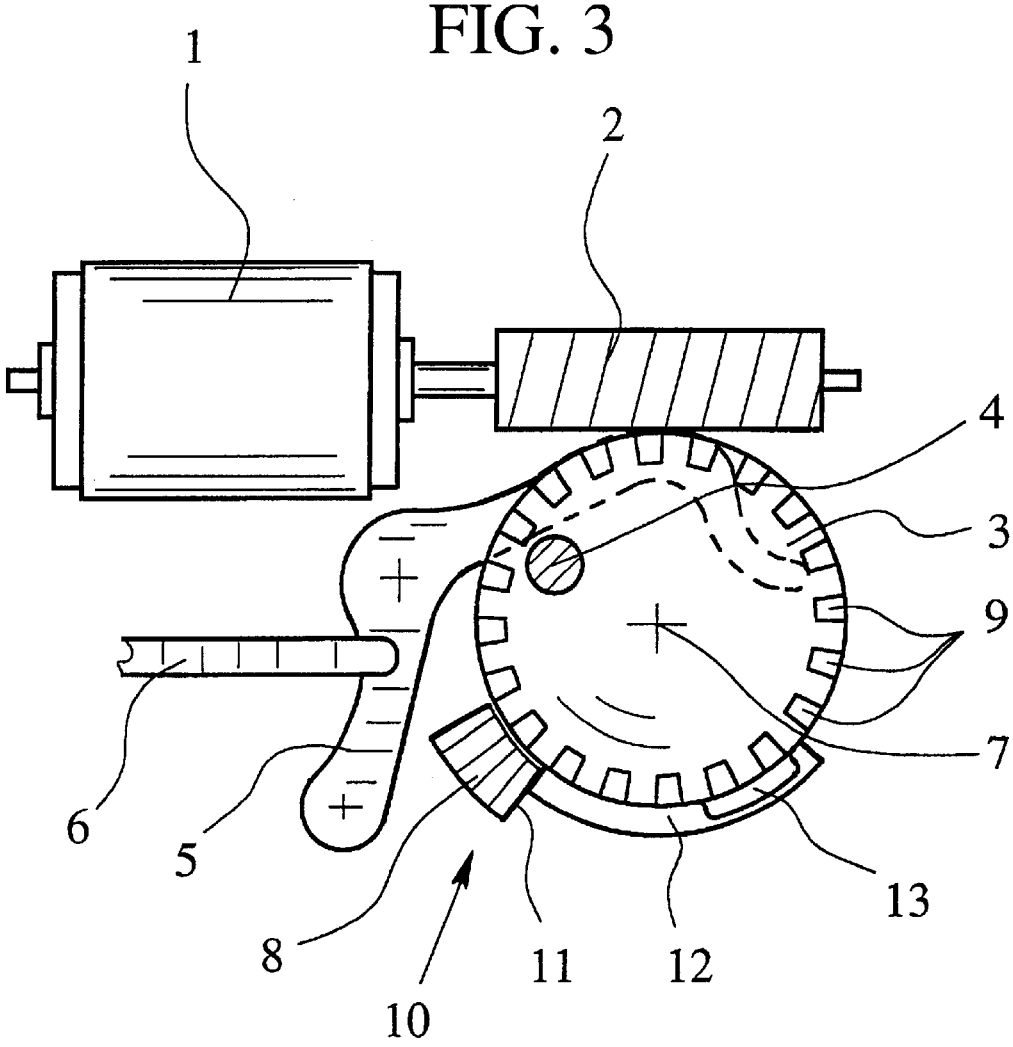
FIG. 3 shows a motor vehicle closing device from FIG. 1 in the "locked" position and offset compensation.

At this point, it is important that, on the positioning element 3 (or if the position detection means 8 should be located on the positioning element 3, on the path of movement of the positioning element 3), in the direction of its motion, there are several passive position detection elements 9 in succession and that position detection takes place by counting the signals of the position detection elements 9 by the position detection means 8. The position detection means 8 is shown in FIGS. 1 to 4 stationary by the path of movement of the turning positioning element 3, conversely the position detection elements 9 on the positioning element 3 are apparent only in FIG. 3, in the other figures for the sake of simplicity they have been omitted. In this embodiment, it is provided that the position detection means 8 has a sensor which is sensitive to magnetic fields and the position detection elements 9 are made as alternatingly magnetic and nonmagnetic pole zones or pole zones which are magnetized with changing polarity. Each of the "boxes" which are apparent in FIG. 3 represents one such pole zone. In one case, the pole zones are identically magnetized and the intermediate spaces are not magnetized, in the other case the pole zones are magnetized with changing polarity.

The position detection means 8 in this embodiment is a Hall sensor, and in another embodiment it could also be a reed contact or the magnetoresistive sensors which are becoming more and more common today. They are incorporated into an evaluation and control circuit to which the sensor signals are transmitted.

Modern arrangements combine the position detection elements 9 in a plastic magnetic strip 9' arrangement carrying magnets 9 inserted in groove 9" in worm wheel 3, as shown in FIG. 3B.

As an alternative, other arrangements are also possible, as shown in FIG. 3C, especially optoelectronic arrangements. It can also be provided as an alternative that the position detection means 8 has a photo emitter 8', photosensitive sensor 8", especially a photoelectric barrier or an optical coupler, and that the position detection elements 9 are made as alternatingly transparent, as indicated by 9'", and opaque or alternatingly reflective or nonreflective zones. In the former case, it would be a crossover photoelectric barrier, in the latter case, a reflector photoelectric barrier or even a corresponding optoelectronic component.

For the latter optoelectronic version, it could be recommended that the position detection elements 9 be combined in an annular gear or rack, the teeth of the annular gear or the rack interrupting the optical coupling between the optical detector and the optical transmitter, the gaps clear this connection.

Basically, it is also possible to combine the operating principles of a magnetic sensor arrangement and an optical sensor arrangement with one another by building the positioning element 3 such that it works like a magnetic aperture sequence.

It can be provided that the position detection elements 9 are integrated into the positioning element 3, conversely it can also be provided that the position detection elements 9 are separately combined and attached to the positioning element 3 which is otherwise conventionally built. The latter amounts to the capacity of the arrangement to be retrofitted.

Otherwise, it should be remembered again that the assignment of the position detection means 8 and the position detection elements 9 to the positioning element and the path of motion can also be done in the reverse.

Even in the arrangement as claimed in the invention which has been further improved in operating reliability, it can happen that the operating point shifts. To prevent this, it can be provided that the positioning element 3 is assigned a reference point sensor 10 by which zeroing-offset balancing—periodically takes place. In this embodiment, the reference point sensor 10 is likewise the position detection means 8 which on one side has an extra switch 11 of any design (contact switch or proximity switch). This is assigned a contact member 12 on the positioning element 3; the contact member is mechanically attached on the outer periphery of the positioning element 3, specifically to a plug-in carrier 13. The contact member 12 in a corresponding size is placed on the plug-in carrier 13; its switching of the extra switch 11 dictates the zero point of the entire means. FIG. 3 shows the locking position which is generally assumed again by the motor vehicle closing device. Whenever the locking position is reached, repeated offset balancing is undertaken which is an additional safeguard against malfunction or switching errors.

It has already been explained above that the positioning element 3 as described can be the worm wheel of a motorized actuator of the motor vehicle closing device. Alternatively, for example, there is a rotary latch or rotary nut of a lock mechanism of one such closing device. In the above explained version with electromechanical offset balancing, the actuator can be made reversible.

The embodiment shown in FIGS. 1 to 4 could also be made such that the extra switch 11 on the reference point sensor 10 is omitted and that the motorized actuator can be controlled, especially turned off, by touching the stop as such (blocking mode). The current rise produced by touching is recognized by the electronics and switches off the electric drive motor. This saves another switch function.

This embodiment can also be operated such that the positioning element 3 has one stop each for clockwise rotation and counterclockwise rotation as the reference point sensor 10, these stops in this representation being implemented by the two sides of one position detection means 8.

Above, it was likewise explained that, when the position detection means 8 is located on the positioning element 3, signal transmission to the control should take place entirely without contact.

From the "ready to open" position from FIG. 1, the worm wheel 3 can turn counterclockwise to execute the "opening" function, conventionally designated as "open by wire." The driver journal 4 then presses the opening lever 5 up and also holds it in this raised position (as a result of the contour of the opening lever 5 relative to the path of motion of the driver journal 4). The positioning element 3 (worm wheel) moves counterclockwise until the contact member 12 encounters the side of the position detection means 8 which in this case forms the reference point sensor 10 for counterclockwise rotation by the above explained current rise as continued running is blocked. The outside door handle is pulled during this entire time, the opening lever 5 remains raised by the operation of the driver journal 4, the detent pawl likewise remains raised. This corresponds to ordinary handling of a mechanical closing device in which the detent pawl also remains raised as long as the outside door handle is pulled.

When the outside door handle is released, a switching function comes into play which turns on the electric drive motor such that the positioning element 3 is turned clockwise. The driver journal 4 returns to the rest position of FIG. 3 or stops in the "unlocked" operating position from FIG. 4.

The reference point sensors 10 also have the advantage that, when the power supply fails and is turned back on, the system is enabled to easily re-orient itself. After being turned back on, the system first proceeds as far as reference point sensor 10 and thus finds a zero point again from which the control is again serviceable.

So that when the power supply fails the system as much as possible does not start in the "wrong" direction of rotation, for example, in the direction of rotation which leads to the "open by wire" function, it can furthermore be regarded as advantageous for the position detection elements 9 to be arranged in an irregular sequence so that, by means of the position detection means 8, not only position detection, but also detection of the direction of rotation are possible.

Figure 3A:
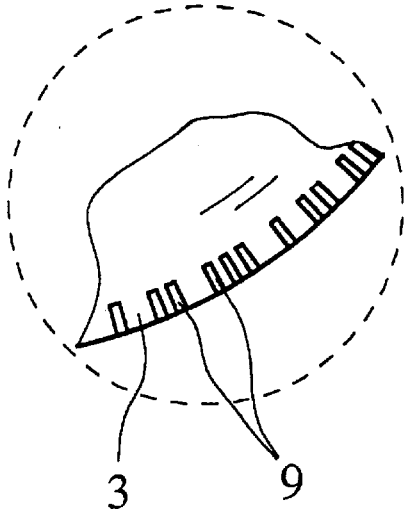
FIG. 3A shows an alternative embodiment of worm wheel and position detection elements.
Figure 4:
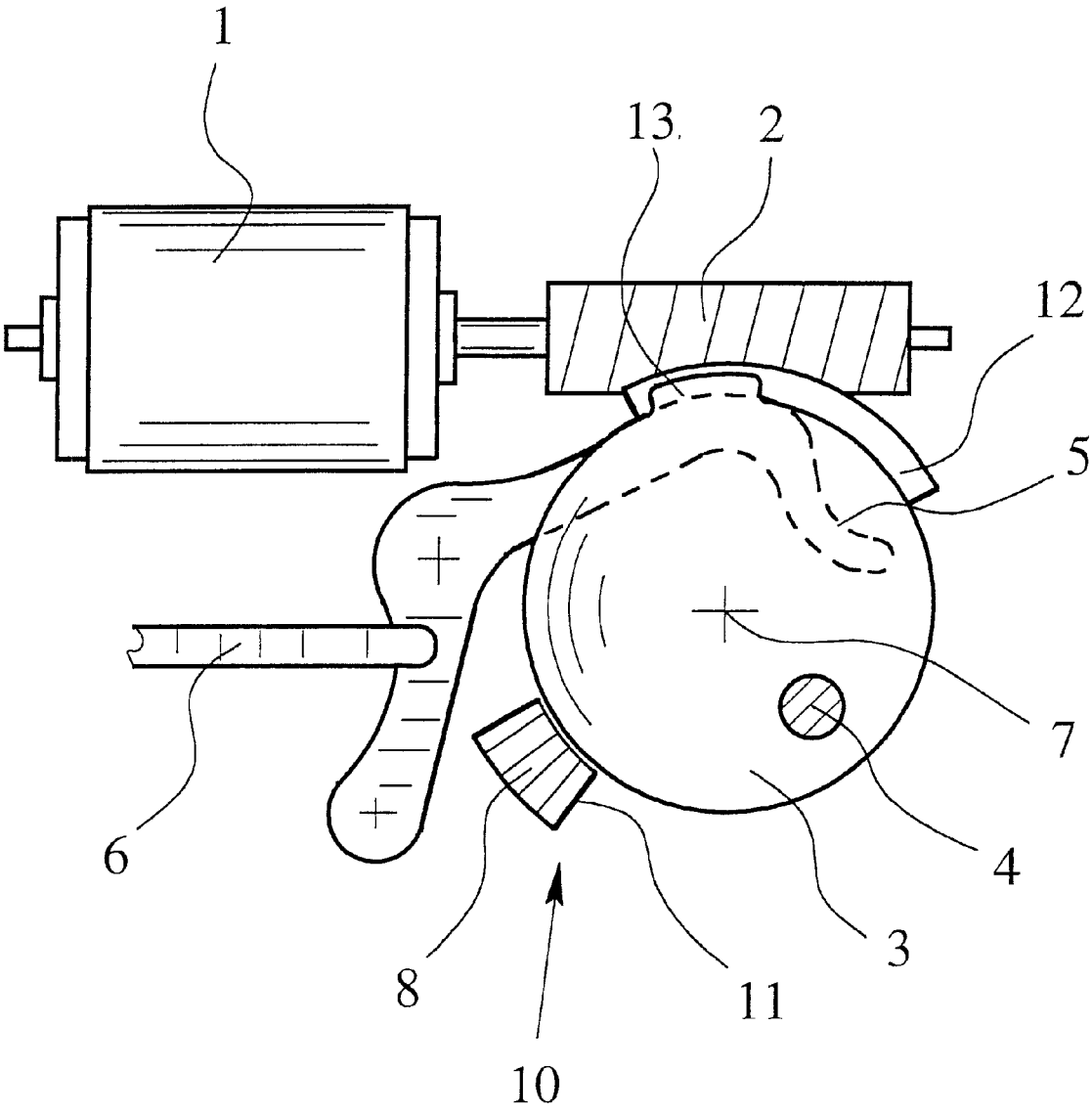
FIG. 4 shows the closing device from FIG. 1 in the "unlocked" position.

FIG. 3A shows one positioning element 3 of one such alternative solution with position detection element 9 arranged in an irregular sequence. Here the sequence is 1/2/3/1 . . . In this embodiment, the position detection means 8 or the electronic control behind it, after a short path of motion of the positioning element 3, "notices" that it is moving in the "wrong" direction and then causes reversal of the direction of rotation of the electric drive motor 1.

What is claimed is:

1. Motor vehicle closing device comprising a moving positioning element and which has a position which is to be ascertained, a position detection means for detection of the positioning element without contact, and a plurality of passive position elements arranged in series on the positioning element; where the position elements are spaced apart from one another; where the position detection means produces counting signals in response to passage of the position elements by the position detection means and has means for preventing shifting of an operating point of the closing device by periodically setting the operating point to a zero point to achieve zeroing in the form of offset balancing.

2. Motor vehicle closing device as claimed in claim 1, wherein the position detection means has a sensor which is sensitive to magnetic fields from the group consisting of a Hall sensor, a reed contact or a magnetoresistive sensor; and wherein the position elements are alternatingly magnetic and nonmagnetic pole zones.

3. Motor vehicle closing device as claimed in claim 2, wherein the position elements are combined in a plastic magnetic strip arrangement.

4. Motor vehicle closing device as claimed in claim 1, wherein the position detection means has a sensor which is sensitive to magnetic fields from the group consisting of a Hall sensor, a reed contact or a magnetoresistive sensor; and wherein the position elements are pole zones which are magnetized with changing polarity.

5. Motor vehicle closing device as claimed in claim 4, wherein the position elements are combined in a plastic magnetic strip arrangement.

6. Motor vehicle closing device as claimed in claim 1, wherein the position detection means has a photosensitive sensor and the position elements are alternatingly transparent and opaque.

7. Motor vehicle closing device as claimed in claim 1, wherein the position detection means has a photosensitive sensor and the position elements are alternatingly reflective and nonreflective zones.

8. Motor vehicle closing device as claimed in claim 1, wherein the position elements are integrated into the positioning element.

9. Motor vehicle closing device as claimed in claim 1, wherein the position elements are separately combined and attached to the positioning element.

10. Motor vehicle closing device as claimed in claim 1, wherein the reference point comprises at least one mechanical stop with a switching function.

11. Motor vehicle closing device as claimed in claim 10, wherein the mechanical stop is adjustable.

12. Motor vehicle closing device as claimed in claim 10, wherein the positioning element is rotatable; and wherein at least one mechanical stop with a switching function comprises a respective stop for each of clockwise rotation and counterclockwise rotation of the positioning element.

13. Motor vehicle closing device as claimed in claim 12, wherein the positioning element is a worm wheel and each stop engages the worm wheel in a respective direction of rotation.

14. Motor vehicle closing device as claimed in claim 1, wherein the positioning element is the worm wheel of a motorized actuator with a worm gear pair.

15. Motor vehicle closing device as claimed in claim 1, wherein the positioning element is a rotary latch of the closing device.

16. Motor vehicle closing device as claimed in claim 1, wherein the positioning element is a rotary nut of a lock mechanism of the closing device.

17. Motor vehicle closing device as claimed in claim 1, wherein the position detection means is located on the positioning element.

18. Motor vehicle closing device as claimed in claim 1, wherein the positioning element is rotatable in opposite directions of rotation; wherein the position detection elements are arranged on the positioning element in an irregular sequence; and wherein said position detection means is also a means for detecting of the direction of rotation of the positioning element.

* * * * *